United States Patent [19]

Martin et al.

[11] 4,090,716

[45] May 23, 1978

[54] GOLF BALL

[75] Inventors: Frank S. Martin, Cranston; Thaddeus A. Pietraszek, Barrington, both of R.I.

[73] Assignee: Uniroyal, Inc., New York, N.Y.

[21] Appl. No.: 671,754

[22] Filed: Mar. 30, 1976

Related U.S. Application Data

[63] Continuation of Ser. No. 156,855, Jun. 25, 1971, abandoned.

[51] Int. Cl.[2] ..... A63B 37/12

[52] U.S. Cl. ..... 273/232; 273/235 A

[58] Field of Search ..... 273/232

[56] References Cited

FOREIGN PATENT DOCUMENTS 377,354 7/1932 United Kingdom ..... 273/232

OTHER PUBLICATIONS

"The Curious History of the Golf Ball" John Stuart Martin, Horizon Press, N.Y. pp. 127–130.

*Primary Examiner*—George J. Marlo

*Attorney, Agent, or Firm*—Jay L. Chaskin

[57] ABSTRACT

A golf ball having improved flight characteristics having a spherical surface with 252 depressions therein. 240 of the depressions are in the shape of inverted pyramids with hexagonal bases and 12 of the depressions are in the shape of inverted pyramids with pentagonal bases. The ball has two poles and an equator, and the pentgonal bases serve as the two poles and as the vertices of similar equilateral spherical triangles into which the surface of the ball may be divided.

14 Claims, 7 Drawing Figures

GOLF BALL

This is a continuation, of application Ser. No. 156,855, filed June 25, 1971, now abandoned.

This invention relates to golf balls, and, more particularly, to golf balls having novel cover markings that give improved flight performance.

One type of conventional golf ball heretofore commonly manufactured has smooth round, somewhat semispherical depressions in its cover. The prior art has suggested various other shapes of depressions for reasons such as improving the light-reflective characteristics of the ball.

It is an object of the present invention, therefore, to provide a new and improved golf ball having better flight characteristics than balls commonly manufactured with semi-spherical shaped depressions therein and, more particularly, to an improved golf ball which can be driven further than prior such balls.

In accordance with the invention, a golf ball comprises an interior body and a spherical surface having a plurality of depressions therein, substantially all of said depressions having substantially the shape of inverted pyramids with hexagonal bases. The ball has two poles and an equator and is divisible into five similar equilateral spherical triangles with a common vertex at a given pole. Each vertex of said equilateral triangles other than the given pole serves as a vertex for a similar spherical equilateral triangle having at least one vertex across the equator therefrom. The ball is divisible into five additional similar equilateral spherical triangles having a common vertex at the other pole and having common vertices with the triangles crossing the equator. The arcs bounding the equilateral triangles pass through the apices of a plurality of the depressions and each equilateral triangle includes within its arcs the same number of depressions and each vertex of the equilateral triangles is in a depression. The equilateral triangles are distributed on the surface of the ball so as to generate an inscribed icosahedral pattern.

For a better understanding of the present invention, together with other and further objects thereof, reference is made to the following description, taken in connection with the accompanying drawings, and its scope will be pointed out in the appended claims.

Referring now more particularly to the drawings.

In forming golf balls, the surface of the ball is formed by placing the ball having its usual covering in a negative mold which is adapted to mold the desired imprint on the surface of the ball. In specifying the surface desired in the ball, it is accepted practice in the art to specify mold dimensions rather than ball dimensions because of the difficulty, inherent in the method of producing these balls, in precisely reproducing the mold dimensions in a series of balls made from the same mold or in a series of identical molds. Furthermore, after the ball is molded it is customary to paint the surface of the ball and, therefore, its surface will depart somewhat from the surface imparted in the mold because of the coating of paint applied to the ball. However, any discrepancies which may occur in the ultimate surface of the ball from that provided on the mold are relatively insignificant, and the exigencies of ball production make it acceptable and desirable to specify the ball surface in terms of the mold dimensions. Accordingly, it should be understood that throughout this specification and claims the ball surface is to be achieved by providing a mold having the stated dimensions, and that a ball produced in such a mold will conform substantially to these dimensions.

Figure 1:
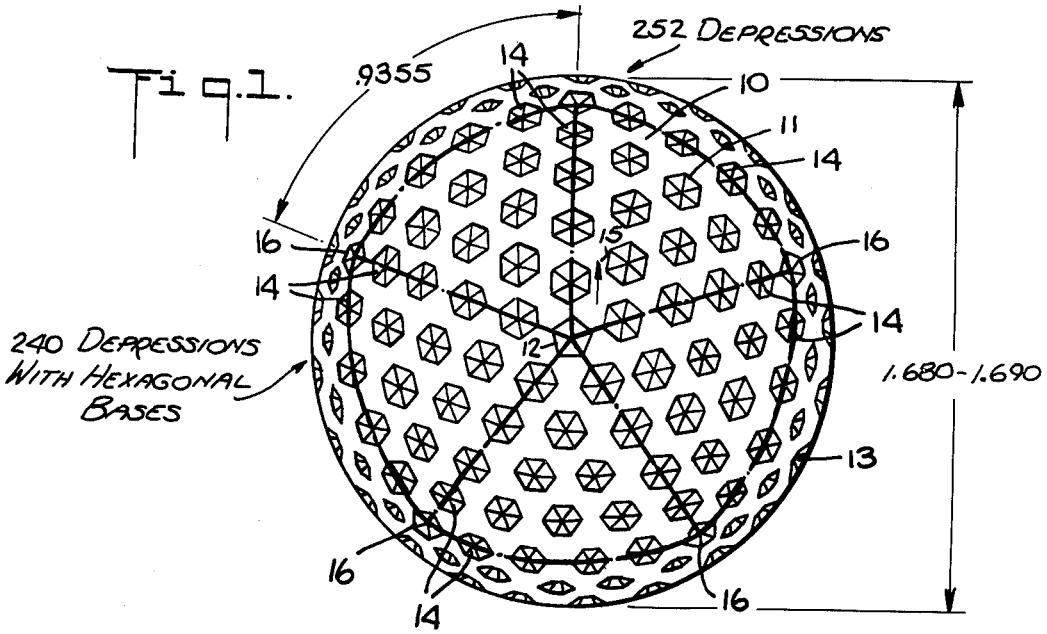
FIG. 1 is a top plan view of a golf ball constructed in accordance with the invention.

Referring now more particularly to FIG. 1 of the drawings, a golf ball comprises an interior body and a spherical surface 10 having a plurality of depressions 11 therein. Substantially all of the depressions have substantially the shape of inverted pyramids with hexagonal bases. The ball has two poles 12 (only one of which appears in FIG. 1) and an equator 13 and is divisible into five similar equilateral spherical triangles indicated by broken lines 14 with a common vertex at a given pole 12. The apex of each pyramid may be slightly rounded as will be described more fully hereinafter. It will be understood that the hexagonal base of the pyramid is substantially hexagonal being on a spherical surface. If the ball is rotated 180° in the direction of the arrow 15, the bottom plan view appears identical with the top plan view and for that reason is not repeated in the drawings.

Figure 2:
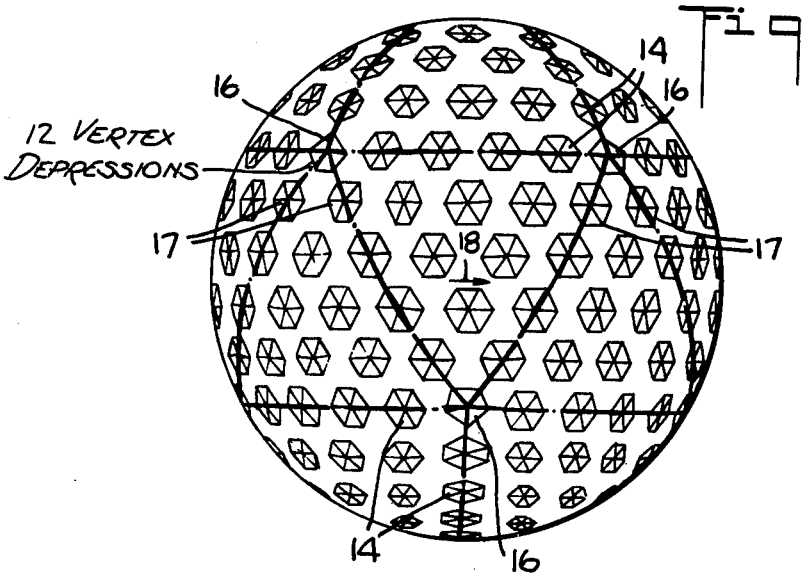
FIG. 2 is a front elevational view of the FIG. 1 golf ball.

Referring now more particularly to FIGS. 1 and 2 of the drawings, each vertex 16 of equilateral triangles 14,14,14 other than the pole 12 serves as a vertex for a similar spherical equilateral triangle 14, 17, 17 having at least one vertex 16 across the equator 13 from another vertex 16 of the triangle 14, 17, 17. Referring to FIG. 2, rotation of the ball by 72° increments in the direction of the arrow 18 would present four additional side and back elevational views which appear identical with FIG. 2 as shown. Accordingly, such additional views are not shown in the drawings.

As mentioned previously, the ball is divisible into five additional equilateral triangles 14, 14, 14 similar to the previously described triangles 14, 14, 14 and having a common vertex at the other pole 12 and having common vertices 16 with the triangles 14, 17, 17 crossing the equator. The arcs 14 and 17 bounding all the equilateral trangles pass through the apices of a plurality of the depressions 11 and each equilateral triangle includes within its arcs the same number of depressions and each vertex of the equilateral triangles is in a depression. It should be understood that lines 14 do not appear on the ball but are demarcation lines which are illustrative only and assist in describing the pattern of the depressions on the surface of the ball. Since there are twenty spherical equilateral triangles, the lines 14 describe an inscribed icosahedral arrangement on the surface of the ball.

All of the depressions 11 except the vertices 12 and 16 of the spherical triangles have substantially the shape of inverted pyramids with hexagonal bases and are of substantially the same size. The depressions 12 and 16 which are the vertices of the equilateral triangles may have substantially the shape of inverted pyramids with pentagonal bases and are of substantially the same size. The pentagonal bases of such pyramids are substantially pentagonal being on a spherical surface. The shape of the depressions 12 and 16 is not critical and the depressions 12 and 16 could, for example, be the shape of conventional semi-spherical depressions.

Figure 3:
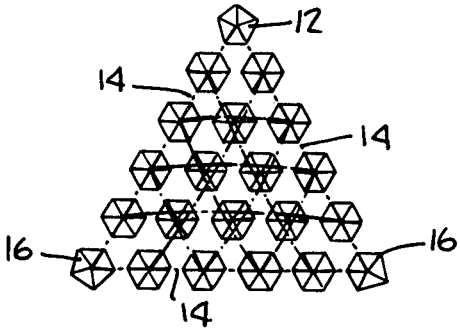
FIG. 3 is a view, to an enlarged scale, of a typical triangular surface section of the FIG. 1 golf ball as developed on a plane surface.

Referring now more particularly to FIG. 3 of the drawings, there is represented a typical triangular surface portion 14, 14, 14 having its vertex at pole 12 developed as if on a planar surface. Pentagons 16 are located at the other vertices. This triangular surface may be formed by utilizing a mold (not shown) in which the bottom of the cavity is a pole. The equator of the mold may then be divided into ten equal parts and five great circles drawn through the pole and the ten divisions. A plane passing through the center of the sphere forms a great circle on the surface of that sphere. With a selected chordal length from vertex to vertex and the pole as center ten intersections may be marked through the great circles. Alternate intersections may be connected with great circles to form five spherical triangles corresponding to triangles 14, 14, 14 of the ball.

The ten divisions along the equator may then be bisected and great circles drawn from the vertices corresponding to vertices 16 of the five spherical triangles to adjacent bisecting points just referred to to form portions corresponding to parts of the triangles 14, 17, 17. A pentagonal region may then be located at each vertex of the mold corresponding to the vertices 12 and 16 shown in FIG. 3. The sides of the spherical triangles may be divided into hexagonal regions corresponding to the uniformly spaced hexagonal regions shown in FIG. 3. All lines interconnecting hexagonal regions shown in FIG. 3 are arcs of great circles. The centers of the hexagonal regions included within triangle 14, 14 14 may be located in the apices of the small triangles formed by the arcs of those great circles as shown in FIG. 3.

The other half of the mold is identical with the half just described but is rotated 36° along the equator with respect thereto. The location of the hexagonal and pentagonal regions of all the spherical triangles of the mold may be determined in accordance with the typical portion just described.

Figure 4:
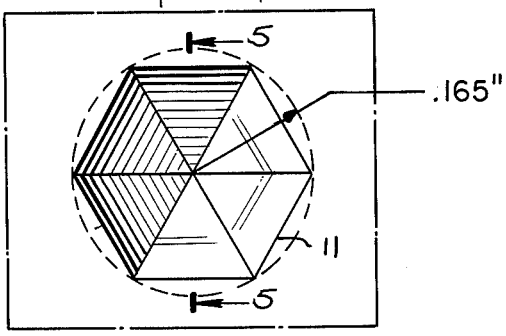
FIG. 4 is a view, to an enlarged scale, of a depression having a hexagonal base.
Figure 5:
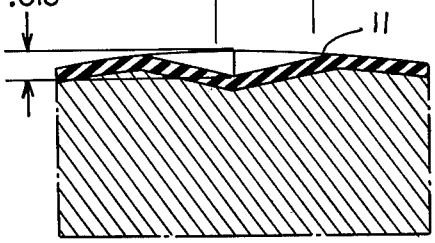
FIG. 5 is a sectional view to an enlarged scale, through the cover of the ball and a portion of the interior winding of the ball to represent a depression having a hexagonal base.
Figure 6:
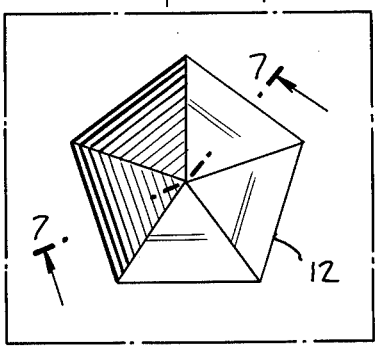
FIG. 6 is a view, to an enlarged scale, of a depression having a pentagonal base.
Figure 7:
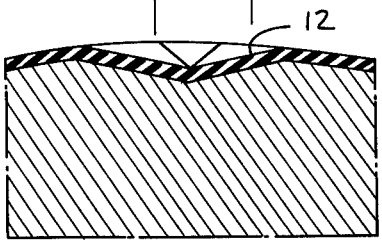
FIG. 7 is a sectional view, to an enlarged scale, through the cover of the ball and a portion of the interior winding of the ball to represent a depression having a pentagonal base.

Referring now more particularly to FIGS. 4 and 5, the hexagonal depression 11 is shown in plan and in section to an enlarged scale. The apex of the hexagonal depression may be slightly rounded. Referring to FIGS. 6 and 7, the pentagonal base preferably has vertices on a circle of the same diameter as the hexagonal base and the pentagonal depression preferably has the same depth as the hexagonal depression. The sides of both the hexagonal and pentagonal pyramids are flat planes but the apices of the pyramids may be slightly rounded. Portions of the usual winding of the ball appear in FIGS. 5 and 7 and the ball has the usual core (not shown). Any of the materials normally used for golf ball covers may be employed as a cover.

The following are the mold specifications for a golf ball of approximately 1.680 to 1.690 inches diameter constructed in accordance with a preferred form of the invention which was found to have longer carry in the air that is, could be driven further in the air, than similar balls with the conventional 336 semi-spherical shaped depressions therein similarly made by the same manufacturer especially for comparison with a ball constructed in accordance with the invention. The tests were conducted on a golf ball driving test machine which gives the ball a consistent and controlled flight. The parameters of the mold for a ball constructed in accordance with the invention were as follows:

| | |
|---|---|
| Number of depression-forming regions | 252 |
| Number of depression-forming regions with hexagonal bases | 240 |
| Number of depression-forming regions with pentagonal bases | 12 |
| Diameter of ball-forming region | 1.690 inches |
| Arc length of equilateral triangle | .9355 inch |
| Chordal length from vertex to vertex | .8884 inch |
| Size of hexagonal and pentagonal bases of depression-forming regions | Vertices on circle of .165 inch diameter |
| Height of hexagonal and pentagonal depression-forming regions from spherical surface | .015 inch |

While there has been described what is at present considered to be a preferred embodiment of this invention, it will be obvious to those skilled in the art that various changes and modifications may be made therein without departing from the invention, and it is, therefore, aimed to cover all such changes and modifications as fall within the true spirit and scope of the invention.

Having thus described my invention, what we claim and desire to protect by Letters Patent is:

1. A golf ball having a spherical surface containing therein a plurality of depression-forming regions distributed over the surface of the ball, the distribution being arranged in a repeating pattern of equilateral spherical triangles, substantially all of the depression-forming regions having substantially the shape of inverted pyramids having an apex with polygonal bases the bases intersecting the surface and capable of being circumscribed by a circle having a diameter of 0.165 inch which passes through the vertices of the polygonal bases and the depression-forming regions having a depth of 0.015 inch.

2. A golf ball according to claim 1, wherein there are approximately 252 depression-forming regions.

3. A golf ball according to claim 1 wherein there are approximately 240 depression-forming regions with hexagonal bases and approximately 12 depression-forming regions which are the vertices of the spherical triangles.

4. A golf ball having a spherical surface; an axis of rotation passing through the center of the ball; a plurality of depressions distributed over the spherical surface in a repeating pattern for a given plurality of increments of rotation about the axis; each depression having a perimeter intersecting with the surface, the perimeter being circumscribed by a respective circle capable of being drawn on the spherical surface, the circle having a diameter of 0.165 inches and touching as many points of the depression perimeter as possible and each depression having a depth of 0.015 inches.

5. A golf ball according to claim 4 wherein the intersection of the axis of rotation with the spherical surface defines a pair of poles on the spherical surface, the depression pattern including five equilateral spherical triangles having a common vertex at each pole.

6. A golf ball according to claim 4 wherein a substantial number of the depressions are polygonally shaped.

7. A golf ball according to claim 4 wherein there are five increments of rotation.

8. A golf ball according to claim 4 wherein the pattern conforms to a regular polyhedron inscribed on the spherical surface.

9. A golf ball having a spherical surface; an axis of rotation passing through the center of the ball and intersecting the surface to define a pair of poles on the surface; a plurality of depressions distributed over the spherical surface, the depressions being arranged in a repeating pattern having a symmetry about each pole; each depression having a perimeter intersecting with the surface and having therein as a vertex a center for a circumscribed circle of 0.165 inch diameter, the circle touching as many points of the depression perimeter as possible, and each depression having a depth from the spherical surface of 0.015 inch.

10. A golf ball according to claim 9 wherein the pattern between the poles conforms to a regular icosahedron inscribed on the spherical surface.

11. A golf ball according to claim 9 wherein the depression pattern includes a plurality of equilateral spherical triangles having a common vertex at each pole.

12. A golf ball according to claim 11 in which all of the depressions except the vertices of the spherical triangles have substantially the shape of inverted pyramids having an apex with hexagonal bases.

13. A golf ball according to claim 11 wherein each spherical triangle contains a substantially equal number of the depressions.

14. A golf ball according to claim 11 wherein each spherical triangle is bounded by an arcuate side, each of the arcuate sides passing through a plurality of the depressions.

* * * * *